United States Patent [19]

Wolfe

[11] Patent Number: 4,878,661

[45] Date of Patent: Nov. 7, 1989

[54] INFLATABLE BULBOUS TOY HAVING A SUBSTANTIALLY NON-BULBOUS CENTER SECTION

[75] Inventor: Henry S. Wolfe, Gulfport, Fla.

[73] Assignee: The Frenry Company, Clearwater, Fla.

[21] Appl. No.: 215,629

[22] Filed: Jul. 6, 1988

Related U.S. Application Data

[63] Continuation-in-part of Ser. No. 927,458, Nov. 6, 1986, abandoned, and a continuation-in-part of Ser. No. 895,263, Aug. 11, 1986, Pat. No. 4,770,408.

[51] Int. Cl.[4] ..... A63G 19/00

[52] U.S. Cl. ..... 272/52; 272/1 B; 441/40

[58] Field of Search ..... 52/2 A–2 J; 272/1 A, 1 B, 52; 441/40; 5/449

[56] References Cited

U.S. PATENT DOCUMENTS

| | | | |
|---|---|---|---|
| 1,851,768 | 3/1932 | Hubbel | 272/1 B |
| 2,830,606 | 4/1958 | Daugherty | 52/2 L |
| 2,837,101 | 6/1958 | Bary | 52/2 L |
| 2,853,720 | 9/1958 | Friedlander | 441/40 X |
| 3,056,980 | 10/1962 | Holladay | 441/40 X |
| 4,336,931 | 1/1982 | Van Staden | 272/1 B |

*Primary Examiner*—Richard E. Chilcot, Jr.
*Attorney, Agent, or Firm*—Herbert W. Larson

[57] ABSTRACT

An inflatable toy construction having a substantially flat or substantially non-bulbous center section that is flanked by bulbous end sections. The center section is formed by a plurality of equidistantly and closely spaced, truncate side-to-side weld lines that define a plurality of small bulbous compartments.

4 Claims, 3 Drawing Sheets

INFLATABLE BULBOUS TOY HAVING A SUBSTANTIALLY NON-BULBOUS CENTER SECTION

CROSS-REFERENCE TO RELATED APPLICATIONS

This is a continuation-in-part of prior application Ser. No. 927,458 now abandoned, filed Nov. 6, 1986 and copending application Ser. No. 895,263 filed Aug. 11, 1986 (Now U.S. Pat. No. 4,770,408).

BACKGROUND OF THE INVENTION

1. Field of the Invention

This invention relates, generally, to inflatable toys-,and more specifically relates to an inflatable toy having a relatively narrow, when seen in plan view, center section that is flanked by a bulbous forward section and a bulbous rearward section.

2. Description of the prior art

Inflatable objects in general are of course well known. The art has developed two different constructions for inflatable objects:

(1) the top-to-bottom or side-to-side weld and (2) the I-beam weld.

The top-to-bottom weld is sometimes called the side-to-side weld where the context requires, but the terminology "top-to-bottom" and "side-to-side" refers to the same technique.

These constructions provide, respectively, bulbous items and substantially flat or substantially non-bulbous items.

In side-to-side welding, the peripheral edges of two flexible materials of the type suitable for use in inflatable construction are brought together and welded together by a process sometimes called heat welding. In this type of "welding", the edges of the respective pieces of materials are momentarily melted while held in pressed relation to one another so that a merger of materials can occur while the heated portions thereof are in a melted state, and a bond is formed when the heat source is removed. The finished product balloons outwardly, assuming a bulbous shape when air is introduced into the compartment defined by the welded edges.

In I-beam construction, the respective edges of the separate materials are not brought together as they are in the side-to-side technique. Instead, an imperforate wall member, also preferably formed of the same materials used to construct inflatables, is positioned along the seam where the top and bottom materials would come together for bonding in the side-to-side method. A first, or top longitudinal edge of a wall is heat welded to one of the pieces of material along a seam and the bottom longitudinal edge of the wall is bonded to the other piece of material along another seam. The seams where a direct bonding would have occurred in the top-to-bottom or side-to-side welding technique are spaced apart by the height of the wall that interconnects them in the I-beam welding technique.

Even when the I-beam technique is employed, same bulbosity will still be present between contiguous baffle walls. The closer together the walls are spaced apart relative to one another, the less bulbosity in the overall item constructed.

Where it is desired to provide a relatively large inflatable object that is substantially flat, the I-beam construction may be suitable. In a large object such as a raft, a plurality of walls are spaced at equidistant intervals throughout the area where flatness or substantial absence of bulbosity is desired.

The co-pending disclosure referred to above discloses an inflatable item having bulbous parts formed by side-to-side welding and non-bulbous parts formed by I-beam welding.

A method is needed to provide an inflatable object having a narrower or substantially non-bulbous center section with bulbous sections in contiguous, flanking relation to such center section where the entire object is formed of the side-to-side welding only. If an inflatable could be constructed so as to have a narrower center section and bulbous outlying portions, then a number of novel items could be constructed which would take advantage of such feature.

SUMMARY OF THE INVENTION

The present invention provides playground rideable toys characterized by narrower center sections and bulbous front and rear sections. The only type of welding used in the inventive constructions is the side-to-side weld.

Using this invention, make-believe inflatable toys such as horses may be constructed having narrow center sections suitable for straddling by a child while maintaining life-like, inflated head and rear portions of generally bulbous construction.

It is the primary object of this invention to provide an inflatable object formed exclusively of side-to-side welds that nevertheless includes a narrower 11 center section that is disposed between and in fluid communication with front and back bulbous sections. Such center section is formed from several substantially linear weld lines positioned at spaced intervals from one another.

BRIEF DESCRIPTION OF THE DRAWINGS

For a fuller understanding of the nature and objects of the invention, reference should be made to the following detailed description, taken in connection with the accompanying drawings, in which

FIG. 6 illustrates how a rider can straddle the present invention with his legs in a near normal walking or running position.

Similar reference numerals refer to similar parts throughout the several views of the drawings.

DETAILED DESCRIPTION OF THE PREFERRED EMBODIMENT

The present disclosure has its primary utility in the construction of inflatable items. It should therefore be understood from the outset that although the drawings appended hereto illustrate an inflatable toy in the form of a horse, such drawings are merely illustrative and the inventive concept has applications in the construction of numerous other inflatable items. For example, the inventive construction revealed herein could be employed to construct toy dinosaurs, giraffes, and the like. The items which could be constructed in accordance with the teachings and suggestions of this invention are virtually unlimited.

Many inflatable items are used in pools or other water environments. The present invention, however, is concerned primarily with non-water related toys. Specifically, the item shown herein for the purpose of illustrating the inventive concepts is a toy of the type that can be straddled by a child standing on dry land.

Figure 1:
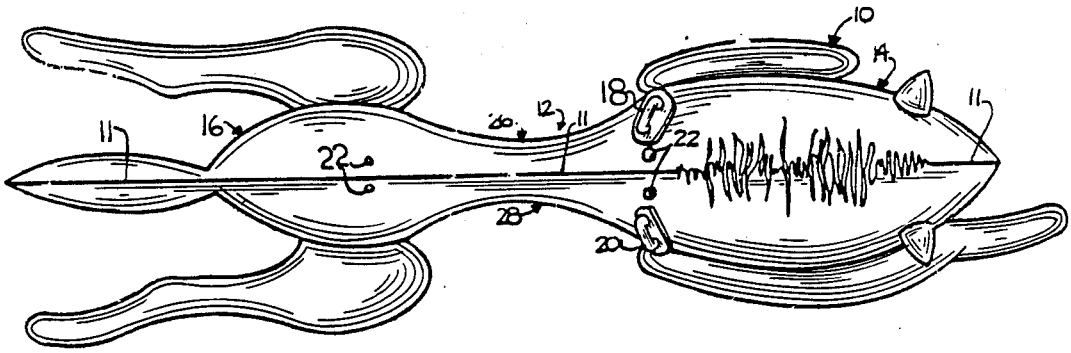
FIG. 1 is a top plan view of a playground ridable toy in accordance with the teachings and suggestions of the present disclosure.

A top view of a horse 10 that is constructed in accordance with the teachings of this invention is provided in FIG. 1. Horse 10 includes three primary sections, two of which are bulbous and one of which is not. Horse 10 is formed by welding together its two half portions along welding line 11 that completely encircles the toy. The weld is of the side-to-side type.

Center section 12 is narrower or non-bulbous as shown whereas the forward and rearward sections, denoted 14 and 16 respectively, of horse 10 are bulbous as depicted.

Figure 4:
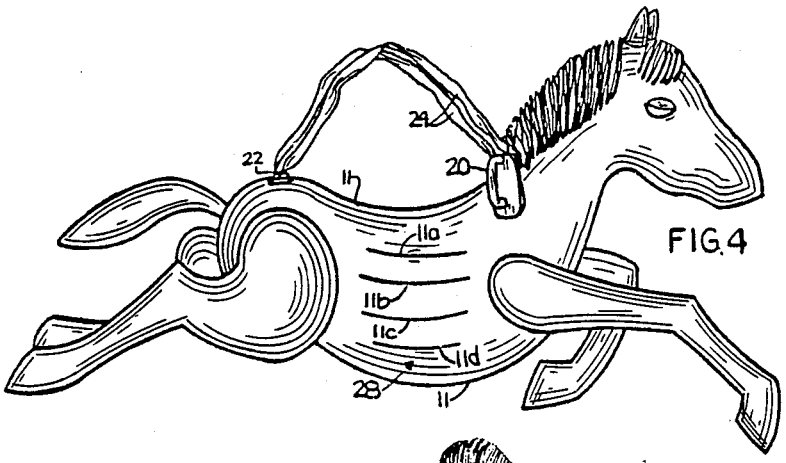
FIG. 4 is a side elevational view similar to that of FIG. 2, but further showing strap members attached thereto.
Figure 5:
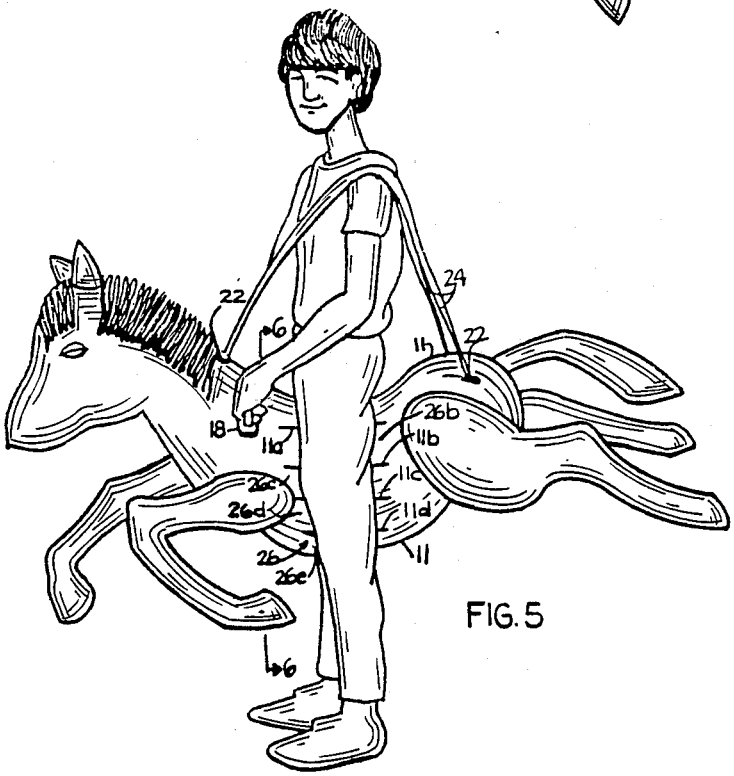
FIG. 5 is a side elevational view similar to that of FIG. 4, but further showing a child wearing the straps and straddling the object.
Figure 6:
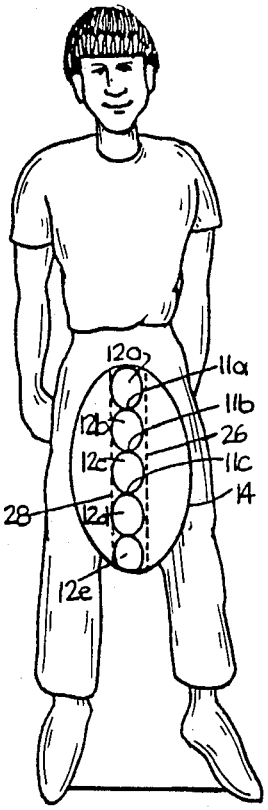
FIG. 6 is a sectional view taken generally along line 6—6 of FIG. 5. The phantom lines represent the substantially non-bulbous center section of the invention.
Figure 7:
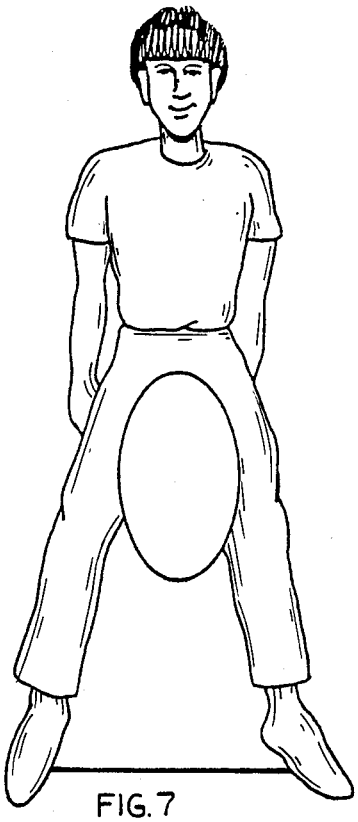
FIG. 7 PRIOR ART
FIG. 7 depicts how a device of the prior art, lacking a narrower center section, would require its rider to awkwardly straddle the same and thereby prevent him from running or walking normally.

The ears, legs, eyes, tail, mane and other well known horse parts are not numbered, nor is the child appearing in FIGS. 5–7. However, handle members 18, 20 are numbered to point them out. Strap connecting members, collectively designated 22, serve to connect the strap members appearing in FIGS. 4 and 5, which strap members are denoted 24.

The child may hold the toy 10 by handles 18, 20, or either of them, disregarding straps 24, or he or she may employ straps 24 and disregard the handles or use any combination thereof.

The length of straps 24 is such tha the toy 10 will be spaced apart from the ground when the child is wearing the straps and straddling the toy as depicted in FIG. 5. The straps are adjustable to accommodate children of different heights.

As is clear from an inspection of FIGS. 1, 5, and 6, a child "riding" toy 10 can freely walk or run with it, whether using handles 18, 20, straps 24 or any combination thereof, due to the narrow width of center section 12.

If center section 12 were formed by conventional side-to-side welding methods, which method is used to form forward and rearward sections 14, 16, then center section 12 also would be bulbous and a child would be unable to walk or run freely while straddling toy 10. FIG. 7 depicts the abnormal stance a child would have to assume if the center section of a straddleable toy were bulbous. Such a stance would substantially prevent normal walking or running as is apparent from said FIG. 7.

As shown in FIG. 1, a first sidewall of horse 10 in the region of center section 12 is denoted 26 and the opposite sidewall thereof is denoted 28.

Figure 3:
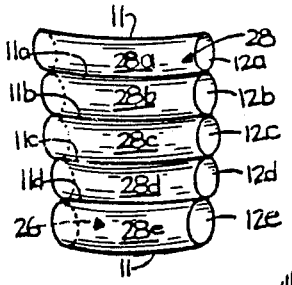
FIG. 3 is an isometric view of the center section of the object shown in FIGS. 1 and 2.
Figure 2:
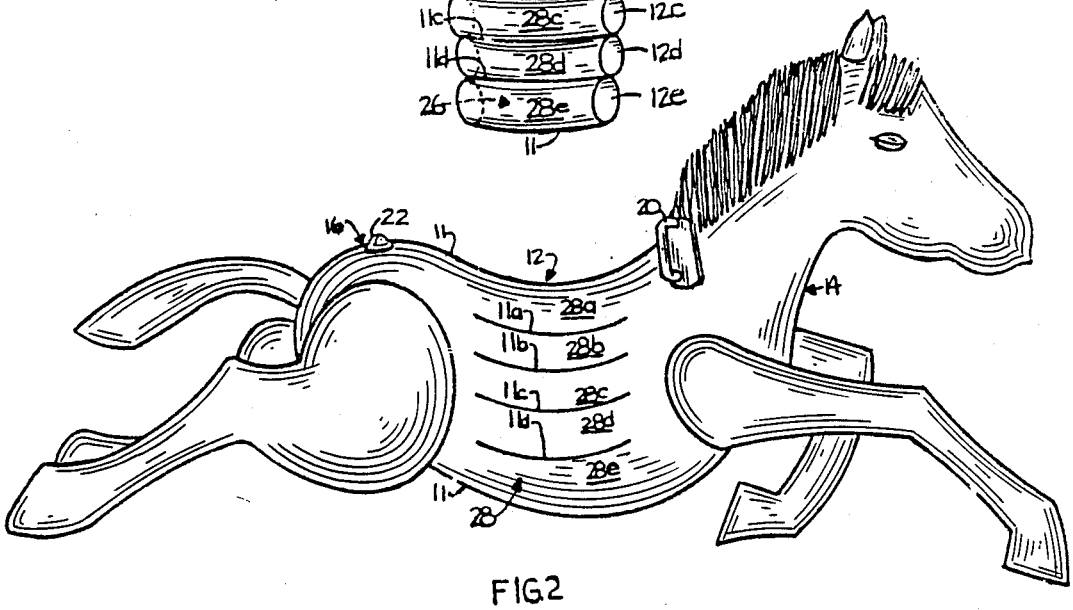
FIG. 2 is a side elevational view of the object shown in FIG. 1.

As is apparent from an examination of FIGS. 1 and 2, side walls 26, 28 are retained or forcibly held in a narrow vertical plane when toy 10 is in use, as a result of the novel side-toside construction thereof which construction is perhaps best understood in connection with FIG. 3.

Side-to-side weld line 11 encircles hoarse 10 at its longitudinal axis of symmetry. Since FIG. 3, is restricted to just the center section 12 of the horse 10, it shows just a portion of weld line 11. It should be noted that the reference numeral 11 appears in FIG. 3 twice, at the top and bottom thereof. The former is the center portion of weld line 11 that appears in FIG. 1 and the latter is the same weld line at the bottom of the horse, as seen in FIG. 2.

The conventional construction of center section 12 would include only said upper and lower welding line 11, producing a bulbous center section shown in FIG. 7.

The inventive construction adds a plurality of equidistantly spaced side-to-side weld lines to the construction of center section 12. Said additional weld lines are denoted **11*a*, 11*b*, 11*c* and 11*d* in FIGS. 2–5**.

Sidewall 26 and sidewall 28 are welded together at each weld line **11, 11*a*, 11*b*, 11*c* and 11*d***.

This produces a plurality of small bulbous sidewalls **28*a*, 28*b*, 28*c*, 28*d* and 28*e* as denoted in FIG. 3. On the opposite side of horse 10, said weld lines produce small bulbous sidewalls 26*a*, 26*b*, 26*c*, 26*d* and 26*e* which are not marked in FIG. 3 to avoid cluttering said figure but which sidewalls are denoted in FIG. 5**.

The bulbous air space between sidewalls **26*a* and 28*a* is denoted 12*a* in FIG. 3. The bulbous air space between sidewalls 26*b* and 28*b* is denoted 12*b* in said figure and so on for the remaining small bulbous air spaces denoted 12*c*, 12*d* and 12*e* in FIG. 3**.

The bulbosity of center section 12 is restricted to the bulbosity of the bulbous air spaces **12*a*–12*e*. The bulbosity is thus very restricted due to the close spacing between the weld lines 11 and 11*a*–11*d*. The cumulative effect of the closely spaced weld lines appears in FIG. 6 where the narrow center section 12** is perhaps best shown.

The narrow center section 12 could be made even more narrow than depicted in the drawings, by introducing additional weld lines. Additional weld lines would provide more of the small bulbous portions **12*a*–12*e*, each of which would exhibit even less bulbosity than said portions 12*a*–12*e***.

This unique combination of narrow and bulbous inflatable sections in an inflatable toy clearly represents an advance in the art of side-to-side welding construction.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An inflatable ridable toy device of the type formed by welding together sheets of flexible material at their respective peripheral edges comprising:

a first bulbous portion;

a second bulbous portion;

a center section interposed between the first and second bulbous portions having a transverse diameter narrower than the transverse diameter of the first and second bulbous portions;

the center section being suitable for straddling by a standing child; and the center section being formed between the peripheral edges by welding together the sheets along a plurality of at least four vertically spaced apart weld lines each adjacent pair of center section welds creating a longitudinal compartment between the welds, the compartment being open ended and in fluid communication with the first and second bulbous portions.

2. The device of claim 1 wherein the welds in the center section are equidistantly spaced apart with respect to one another and with respect to the peripheral weld.

3. A method of forming a rideable toy device having a first bulbous portion, a second bulbous portion and a center portion between the first and second portions comprising welding together two sheets of flexible material at their respective peripheral edges and welding together multiple longitudinal lines from each sheet in a vertical spaced apart pattern at the center portion of the toy device so that multiple adjacent compartments are formed and the center portion of the toy is narrower than the first and second bulbous portions.

4. The method according to claim 3 wherein there are at least four longitudinal lines welded in the center portion of the toy in addition to the peripheral weld.

* * * * *